United States Patent [19]

Paul

[11] 4,143,613

[45] Mar. 13, 1979

[54] DOCKING APPARATUS

[76] Inventor: William A. Paul, 1808 Parkside Blvd., Toledo, Ohio 43607

[21] Appl. No.: 819,289

[22] Filed: Jul. 27, 1977

Related U.S. Application Data

[63] Continuation-in-part of Ser. No. 746,496, Dec. 1, 1976, Pat. No. 4,073,255.

[51] Int. Cl.[2] ..... B63B 21/00

[52] U.S. Cl. ..... 114/230; 114/221 R

[58] Field of Search ..... 24/230.5 R, 231, 241 R, 24/236, 237; 294/20, 82 R; 114/221 R, 230

[56] References Cited

U.S. PATENT DOCUMENTS

| | | | |
|---|---|---|---|
| 977,158 | 11/1910 | Berkstresser | 294/20 |
| 2,845,892 | 8/1958 | Jorgenson | 114/230 |
| 2,912,953 | 11/1959 | Olsen | 114/230 |
| 2,931,853 | 4/1960 | Wilson | 24/230.5 |
| 2,938,492 | 5/1960 | Kuzick | 114/230 |
| 2,965,064 | 12/1960 | Wallace | 114/230 |
| 2,990,641 | 7/1961 | Weidman | 43/43.16 |
| 3,590,767 | 7/1971 | Dunbar | 114/230 |
| 3,820,195 | 6/1974 | Hutzell | 24/230.5 R |
| 3,861,731 | 1/1975 | Young | 114/221 R |
| 3,863,383 | 2/1975 | Lore | 43/43.6 |

FOREIGN PATENT DOCUMENTS

| | | | |
|---|---|---|---|
| 613773 | 12/1945 | United Kingdom | 114/230 |

*Primary Examiner*—Trygve M. Blix
*Assistant Examiner*—D. W. Keen
*Attorney, Agent, or Firm*—Allen D. Gutchess, Jr.

[57] ABSTRACT

Docking apparatus is provided for aiding in the docking or mooring of a boat. The apparatus is particularly advantageous for larger pleasure boats which may have but one pilot or operator but which normally require more than one person to dock the boat. The apparatus includes a line held in an extended position by a mooring post on the side which the boat approaches. A line-engageable member is mounted on the boat and is positioned to engage the line as the boat approaches the docking area. In a preferred form, the line-engageable member is a hook and is mounted so as to be swung or extended outwardly from the boat in one position and to be retracted and out of the way in another position. The line is preferably releasably held relative to the post so that it will be partly released when engaged by the hook but will still be fastened to the dock or the post. Once the hook engages the line and the boat is stopped, the operator can then fasten additional mooring lines as desired.

11 Claims, 9 Drawing Figures

DOCKING APPARATUS

This application is a continuation-in-part of my copending application Ser. No. 746,496, filed Dec. 1, 1976, now U.S. Pat. No. 4,073,255

This invention relates to apparatus for aiding in the mooring or docking of a boat.

Many boats can be difficult to dock, especially by one person, and especially under adverse conditions as where wind or waves are present. The operator frequently must leave the steering wheel or the outboard motor handle to be able to reach over to the dock or mooring post in order to secure a line thereto. In doing so, the operator also relinquishes control of the boat. As a consequence, the boat may drift or blow away from the dock before a tie-up can be made.

The present invention provides docking apparatus which enables an operator to secure a line from a dock or mooring post to the boat without having to leave the controls of the boat. The apparatus includes a mooring line which is releasably held in an extended position by a post or the like on the side from which the boat approaches. A suitable resilient arm can be employed for this purpose. A line-engageable member, preferably in the form of a hook, is mounted on the boat and engages the line as the boat approaches the dock. A temporary connection is thereby achieved between the dock and the boat with the operator then tying up additional mooring lines if desired. The line is preferably releasably held by the resilient arm to prevent abrupt stopping of the boat when the line is engaged. Further, the line-engageable hook preferably is mounted on the boat in a manner such that it can extend from the boat as the boat approaches the dock, but otherwise is held in a retracted, out of the way position.

It is, therefore, a principal object of the invention to provide apparatus for facilitating the docking of a boat, particularly by one operator.

Many other objects and advantages of the invention will be apparent from the following detailed description of a preferred embodiment thereof, reference being made to the accompanying drawings, in which.

Figure 1:
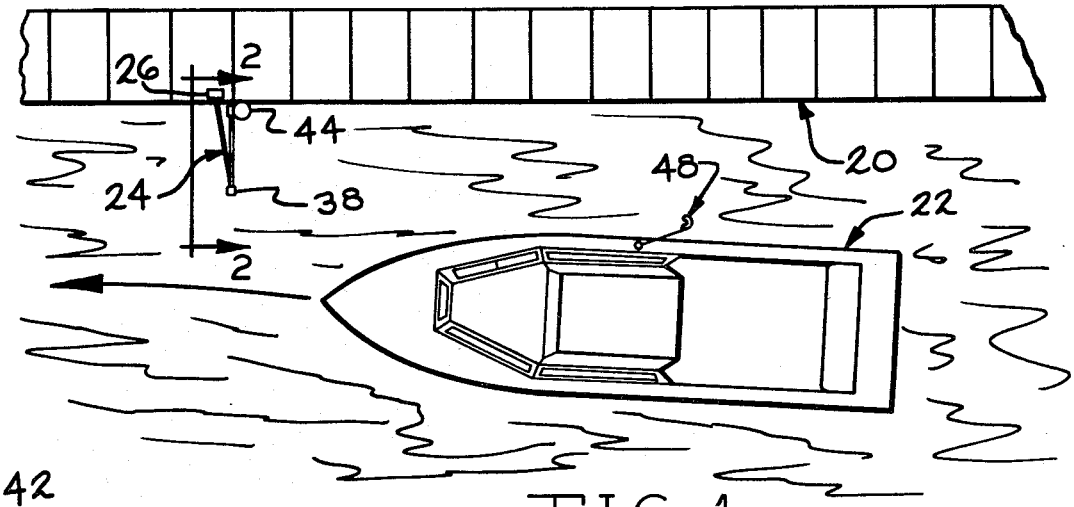
FIG. 1 is a schematic plan view of a boat and a dock having a docking device embodying the invention.
Figure 2:
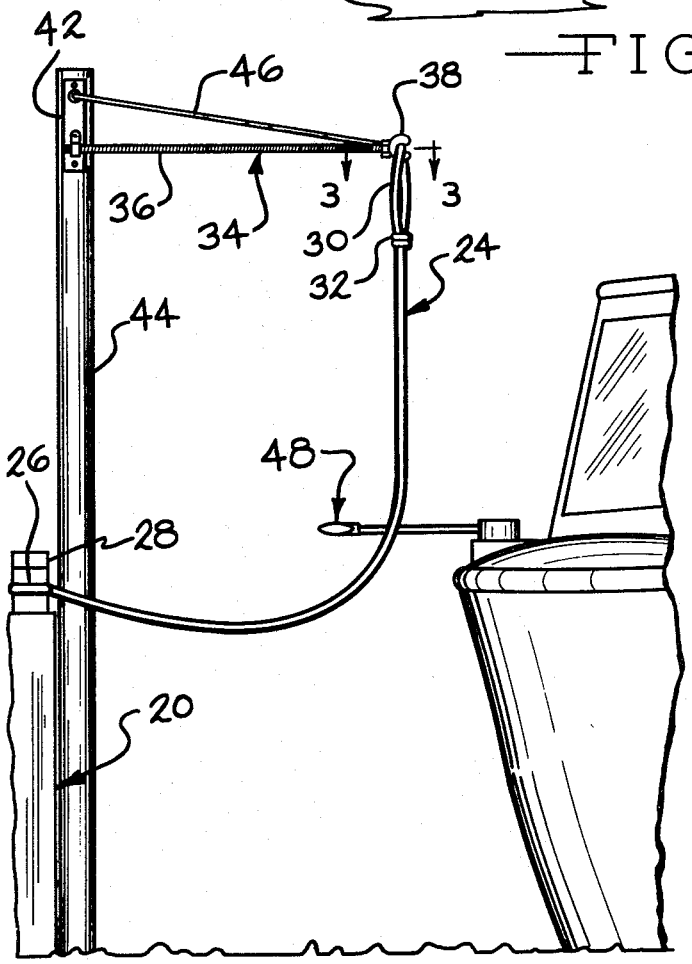
FIG. 2 is a view in elevation taken along the line 2—2 of FIG. 1.

Referring to the drawings, and particularly to FIG. 1, a stationary dock or the like is indicated at 20 and is being approached by a boat indicated at 22. The boat may have only one operator or pilot and is of a size such that it is difficult to dock, particularly by only one person, and especially under adverse conditions, such as strong winds or high waves being present.

Figure 3:
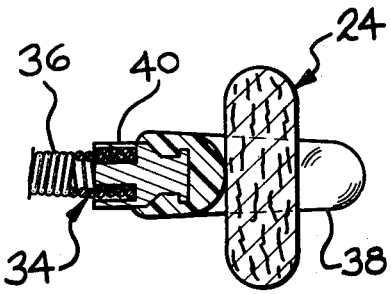
FIG. 3 is an enlarged, fragmentary, detailed view taken along the line 3—3 of FIG. 2.

Docking apparatus according to the invention includes a mooring line 24 having an end 26 affixed to an anchor member or cleat 28 on the dock 20 with the other end of the line 24 having a loop 30, at the end of which is formed a knot 32. A portion of the line 24 spaced from the loop 30, and preferably an intermediate portion of the line between the loop and the anchored end 26, is held in a suspended condition by a suspension device 34, which engages the loop 30. The device 34, in this instance, includes a resilient arm 36, which can be in the form of a coil spring, having resilient fingers 38 formed at the outer end thereof. As shown in FIG. 3, the resilient fingers 38 are of rubber and have a connection 40 molded therein which receives an end of the arm 36. The inner end of the arm 34 is connected to a bracket 42 which is fastened to a mooring post 44 or other anchoring means associated with the dock 20. Since the arm 36 is highly flexible, to even avoid damaging a boat hitting it directly on the end, a wire 46 is connected to the fingers 38 and suspends the arm, the inner end of the wire being affixed to an upper portion of the bracket 42. This enables the arm 36 to support the weight of the mooring line 24 and yet still be highly flexible.

Figure 4:
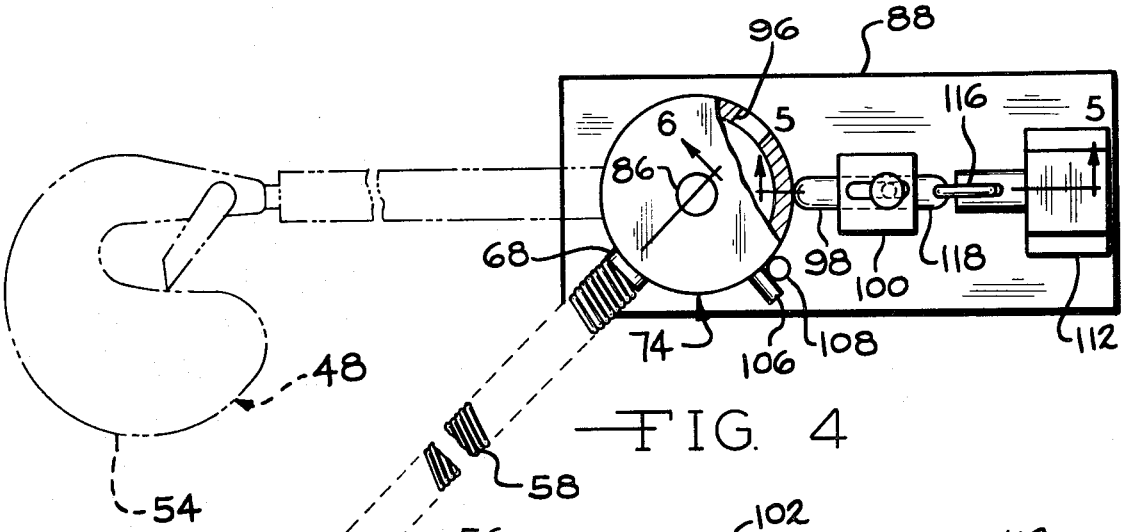
FIG. 4 is a fragmentary, plan view of a part of the docking device mounted on the boat.
Figure 5:
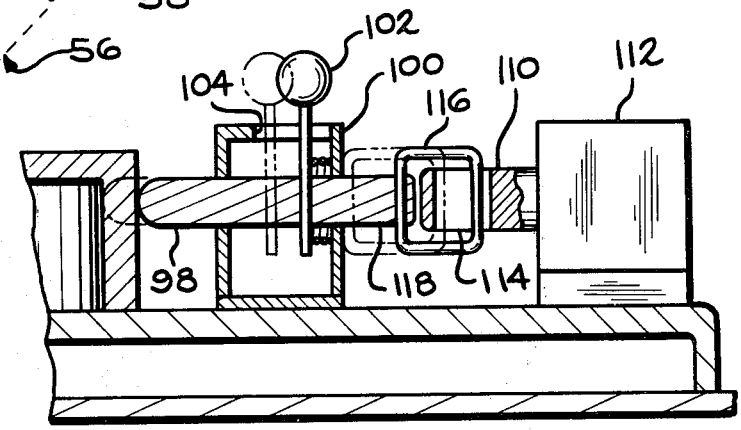
FIG. 5 is a fragmentary view in cross section taken along the line 5—5 of FIG. 4.
Figure 6:
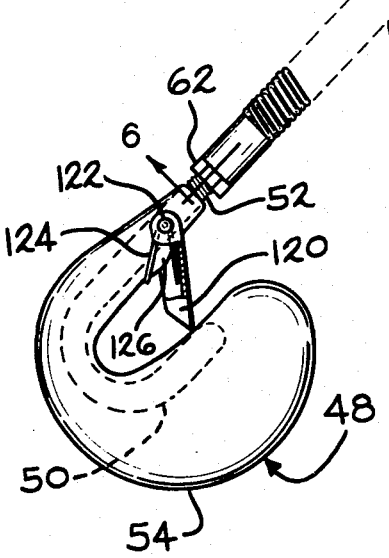
FIG. 6 is a fragmentary view in transverse cross section taken along the line 6—6 of FIG. 4.
Figure 6:
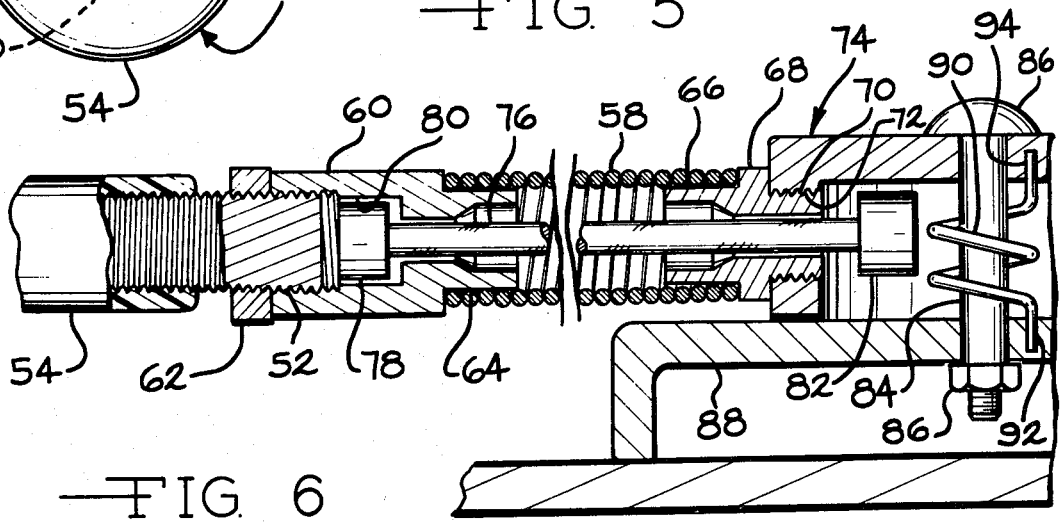

The docking apparatus also includes a line-engageable member associated with the boat 22 for engaging the suspended line 24 when approaching the dock. Referring to FIGS. 4–6, a line-engageable member is shown as a hook 48 and specifically includes a rigid hook core 50 terminating in a threaded end 52, with a large bulbous covering 54 on the hook core 50, and extending outwardly beyond the free end thereof. This particular design of the hook 48 with the large bulbous cover 54 prevents the hook from accidentally catching on such protuberances as the mooring post 44. Rather, the hook will simply tend to bounce off such protuberances without catching and causing damage to the protuberances or the boat.

The hook 48 is mounted on a resilient, flexible arm 56 which includes a coiled spring 58 of sufficient rigidity to support the hook 48 in a position extending horizontally from the boat. The threaded end 52 of the hook core is turned into an outer fitting 60 and held in the horizontal position by a jam nut 62. The fitting 60 has a necked-down portion 64 which is received in the spring 58 and held by any suitable means such as by brazing. The opposite end of the spring 58 fits over a neck 66 of an inner fitting 68 having a threaded end 70 turned into a tapped opening 72 of a housing 74. A small elongate member or cable 76 which is strong in tension extends completely through the spring 58 and constitutes part of the arm 56. The outer end of the cable has an enlargement 78 received in a recess 80 of the fitting 62 while the inner end of the cable has an enlargement 82 located within the housing 74 slightly beyond the threaded end 70 of the fitting 68. This extra length of the cable 76 enables the spring 58 to bend which could not readily occur if the cable were tightly connected at the ends to the fittings 60 and 68. The arm 56 thus has resiliency and flexibility and yet is strong in tension due to the cable 76.

The housing 74 has a central post or shoulder bolt 84 having an upper head 86 and a lower end receiving a nut 86 below a mounting plate 88. The post 84 has a shoulder at the lower threaded end to limit the extent to which the nut 86 can be turned thereon. This enables the housing 74 to be pivotally movable on the mounting plate 88. A torsion spring 90 is located around the post 84 and is affixed in the plate 88 at a lower end 92 and is affixed to the housing 74 at an upper end 94. As viewed in FIG. 4, the torsion spring 90 urges the housing 74 in a counterclockwise direction.

The housing 74 has an opening or recess 96 in the side which can receive a pin 98 to hold the hook 48 in an out-of-the-way or retracted position so as not to extend beyond the side of the boat. The pin 98 is mounted in a guide 100 for slidable movement relative thereto. As shown in FIG. 5, the pin has a releasing knob 102 extending upwardly therefrom through a slot 104 in the guide 100. The knob can be pulled back manually to release the pin 98 from the recess 96. The torsion spring 90 then causes the housing 74 to pivot in a counterclockwise direction until an extension stop 106 extending from the housing hits a stop pin 108 mounted on the plate 88.

If desired, the pin 98 can be remotely released by an armature 110 of a solenoid 112. The armature 110 has a slot 114 through which a link 116 connects the armature to a rear portion 118 of the pin 98. The slot 114 enables the pin 98 to be retracted manually even when the armature 110 of the solenoid is in its forward, deenergized position, as shown in FIGS. 4 and 5. When the solenoid 112 is energized, it retracts the armature 110 and releases the pin 98 from the recess 96 to enable the hook 48 to swing to its outer, engageable position. The solenoid can be energized by a switch located at the operator's controls so that he can render the hook operative without leaving the controls of the boat.

When the hook 48 is in its engageable position and engages the mooring line 24, the suspended portion of the line is received by the hook and is held by a releasable catch 120 which is pivotally mounted on the hook core 50 by a pin 112 and is urged to the blocking position of FIG. 5 by a torsion spring 124. This is a light spring which enables the catch to be readily deflected when engaged by the mooring line, with the catch then returning to the outer position to hold the line securely in the hook. The catch 120 is certain to be deflected when the loop 30 is stripped from the fingers 38, if not before. The suspended portion of the line then slides through the hook until the hook engages the knot 32. The boat then stops when the line 24 becomes taut between the anchor member 28 and the hook 48 with the spring 58 being stretched slightly until the cable 76 is under tension. The covering 54, which can be of rubber or a resilient plastic, can have a bulbous portion 126 which must be depressed by the catch 120 to release the line. This provides additional resistance to the release of the line and helps to assure that the line will not slip out of the hook. The pilot or operator can then place the looped portion 30 of the line 24 around a cleat on the boat, if desired, and can tie up other mooring lines from the boat to the dock.

Figure 8:
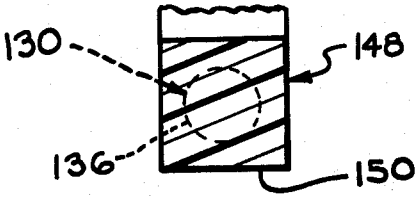
FIG. 8 is a view in transverse cross section taken along the line 8—8 of FIG. 7.
Figure 7:
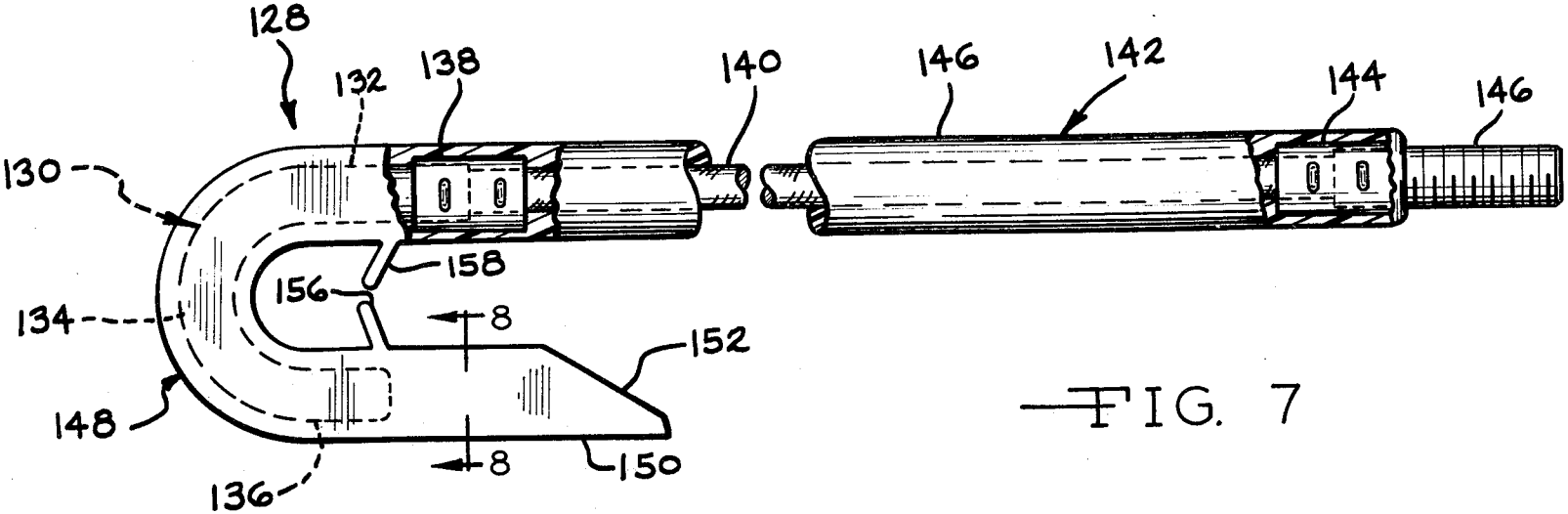
FIG. 7 is a fragmentary, plan view, with parts broken away and with parts in section, of a modified line-engageable member and arm.

Referring to FIGS. 7 and 8, a modified hook of a line-engageable member and a modified arm are shown. A hook indicated at 128 specifically includes a rigid hook core 130 made of a metal rod and including a shank portion 132, a U-shaped portion 134, and a free end portion 136. The shank portion 132 has a connecting sleeve 138 staked thereto which connects the core 130 to a cable 140 of a flexible arm 142. The cable 140, in turn, is staked to a second connecting sleeve 144 which connects the cable to a threaded connector 146 by means of which the arm 142 can be connected to the housing 74 of FIGS. 4 and 6. A tubular sheath or cover 146 of suitable plastic, such as urethane, encases the cable 140 and provides structural rigidity or stiffness for the arm 142 to enable the arm to maintain the hook 128 in a horizontal position when the line-engageable member is in the extended position, as shown in FIG. 1. At the same time, the cable 140, which can be aircraft cable, provides a strong tension member for the arm 142 when the hook 128 engages the line 24. The combination of the sheath and cable enable the arm 142 to be flexible and yet resilient so as to return to the original position when deflected by a protuberance, as in FIG. 9. The arm 142 has the advantage over the arm 56 that it is substantially less expensive to manufacture.

A sheath or cover 148 of suitable plastic material, such as urethane, also encases the hook core 130 and constitutes part of the hook 128. As shown, the cover 148 is of rectangular transverse cross section but can also be rounded or tubular as is the sheath 146. Of particular importance, the cover 148 has an extension 150 extending well beyond the free end portion 136 of the core 130 and terminates in a slanted end 152. The slanted surface is in a plane perpendicular to the plane of the hook (as taken centrally through the shank, U-shaped, and free end portions of the core). The tip of the slanted end is preferably away from the shank portion of the core and the arm 142.

Figure 9:
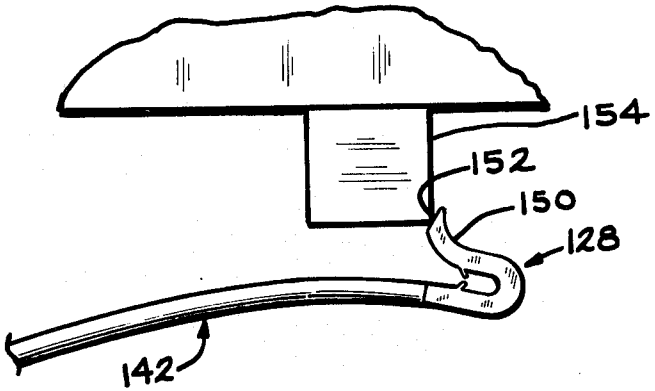
FIG. 9 is a plan view of the line-engageable member and arm of FIG. 7 in contact with a protuberance of a dock.

As shown in FIG. 9, the cover extension 150 bends outwardly when engaging a protuberance indicated at 154 and will not catch thereon. Even if the extension 150 engages the protuberance perpendicularly, the slanted end 152 causes the extension 150 to bend outwardly, as shown in FIG. 9, and to "push off" the protuberance. To achieve this effect, the extension 150 should have a length of from one to nine times the thickness of the cover 148 at the free end 136 of the hook core 130 with the range preferably being from one and one-half to six times the thickness. The thickness here is defined as the dimension across the cover taken in the plane of the hook. The length of the extension also depends on the stiffness of the plastic used in the cover. It also is affected by the length of the arm 142, since if the extension extends too far up the arm, it will deflect the line 24 too often, rather than engage it in the bite of the hook.

In place of the separate catch 120 of FIG. 4, integrally molded catches 156 and 158 can be formed on the cover 148 and extend inwardly to hold the line 24 in the bite of the hook. This further reduces the cost of the hook. Rather than the two catches 156 and 158, a single one of longer length can be employed in place of either of these two catches.

Various modifications of the above-described embodiments of the invention will be apparent to those skilled in the art, and it is to be understood that such modifications can be made without departing from the scope of the invention, if they are within the spirit and the tenor of the accompanying claims.

I claim:

1. Line-engageable means for aiding in docking a boat to a stationary dock member or the like, said means comprising an arm having a cable and an outer sheath providing stiffness for the cable, and a hook having a hook core of a metal rod including a shank portion, a generally U-shaped portion, and a free end portion, means affixing said shank portion to an end of said cable, and a sheath encasing said hook core and extending beyond the free end portion thereof.

2. Line-engageable means according to claim 1 characterized by said hook sheath extending axially a substantial distance beyond the end of said free end portion of said hook core.

3. Line-engageable means according to claim 2 characterized by the free end of said sheath being slanted.

4. Line-engageable means according to claim 1 characterized by said hook sheath having a catch integrally molded thereon adjacent one of said shank portion and said free end portion of said core and extending toward the other.

5. Line-engageable means according to claim 4 characterized by said hook sheath having a second catch integrally molded thereon adjacent the other of said shank portion and said free end portion and extending toward the first catch.

6. Line-engageable means for aiding in docking a boat to a stationary dock member or the like, said means comprising an arm, a hook comprising a rigid hook core made of a metal rod and including a shank portion, a U-shaped portion, and a free-end portion having a blunt end, said hook also comprising a plastic sheath substantially completely encasing said core and having an extension extending substantially axially of the free-end portion of said core and a substantial distance therebeyond for bending when engaging a protuberance to prevent the hook from catching thereon, and means affixing said shank portion of said hook to said arm.

7. Line-engageable means according to claim 6 characterized by said extension extending beyond the free end portion of said hook by a distance from one to nine times the thickness of said sheath as measured in the plane of the hook at the free end portion of said core.

8. Line-engageable means according to claim 7 wherein said extension extends beyond the free end portion by a distance from one and one-half to six times the thickness of the sheath.

9. Line engageable means according to claim 6 characterized by the free end of said extension being slanted in a plane perpendicular to the plane of said hook.

10. Line engageable means according to claim 9 characterized by the extremity of the slanted end being at the edge of said sheath opposite the shank portion thereof.

11. Line engageable means according to claim 6 characterized by said sheath having a catch molded on a portion thereof adjacent one of said shank portion and said free end portion and extending toward the other of said shank portion and said free end portion.

* * * * *